US005476070A

United States Patent [19]

Gwon et al.

[11] Patent Number: 5,476,070

[45] Date of Patent: Dec. 19, 1995

[54] FIRST WALKER'S AID

[76] Inventors: Lay Gwon, 25-19 14th Pl., Astoria, N.Y. 11102; George Spector, 233 Broadway Rm 702, New York, N.Y. 10279

[21] Appl. No.: 243,712

[22] Filed: May 16, 1994

[51] Int. Cl.[6] ..... A62B 35/00

[52] U.S. Cl. ..... 119/770; 434/255

[58] Field of Search ..... 119/770, 857, 119/907; 434/254, 255; 482/55, 69

[56] References Cited

U.S. PATENT DOCUMENTS

| | | | |
|---|---|---|---|
| 602,861 | 4/1898 | Lyon | 119/770 |
| 1,193,374 | 8/1916 | Gilliam | 434/255 X |
| 1,651,561 | 12/1927 | Storey | 119/770 |
| 4,666,017 | 5/1987 | Zimmerman | 119/770 |
| 5,325,818 | 7/1994 | Leach | 119/770 |

*Primary Examiner*—Robert P. Swiatek

[57] ABSTRACT

A first walker aid is provided for an infant, which consists of a chest strap applied about the upper torso of the infant to pass under the arms. Components are for adjustably fastening the ends of the chest strap together at the back of the infant. A pair of shoulder straps are each spaced apart and connected to the chest strap, so as to extend over the shoulders of the infant. Elements are for adjusting each shoulder strap, so that the shoulder straps will properly fit onto the shoulders of the infant. A hold handle strap is affixed to the chest strap at the back of the infant, so that an adult can grip the hold handle strap to retain the infant when walking and prevent the infant from falling down.

1 Claim, 1 Drawing Sheet

FIRST WALKER' S AID

BACKGROUND OF THE INVENTION

The instant invention relates generally to children's harnesses and more specifically it relates to a first walker aid, which provides straps worn on an infant and held by an adult to prevent the infant from falling when taking first steps.

There are available various conventional childrens harnesses which do not provide the novel improvements of the invention herein disclosed.

SUMMARY OF THE INVENTION

A primary object of the present invention is to provide a first walker aid that will overcome the shortcomings of the prior art devices.

Another object is to provide a first walker aid that includes a strap assembly worn on an infant and held by an adult, so as to prevent the infant from falling down and hurting themselves when the infant is taking first steps.

An additional object is to provide a first walker aid in which the strap assembly includes straps that are comfortably worn about the chest and shoulders of the infant, while a hold handle strap is gripped by the adult from the back of the infant, which will stabilize the infant when walking.

A further object is to provide a first walker aid that is simple and easy to use.

A still further object is to provide a first walker aid that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
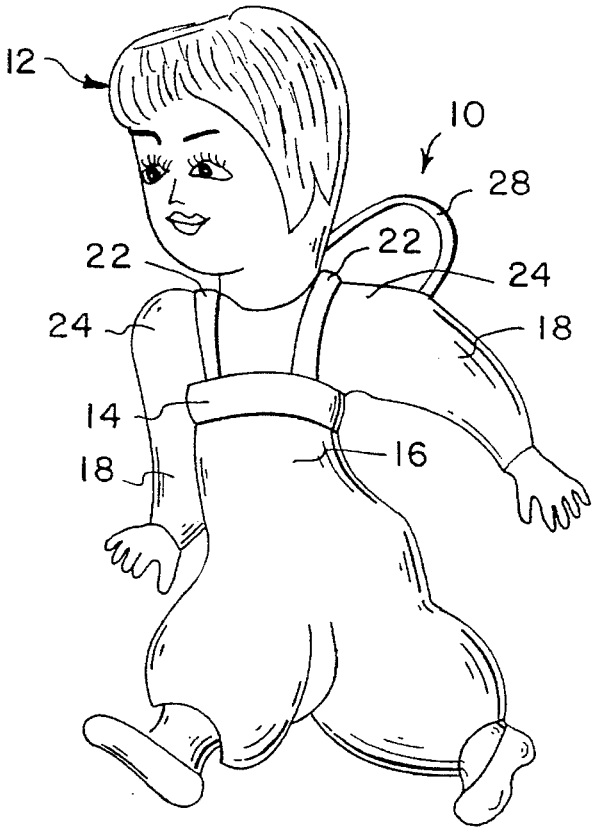
FIG. 1 is a side perspective view of the instant invention worn on an infant.
Figure 2:
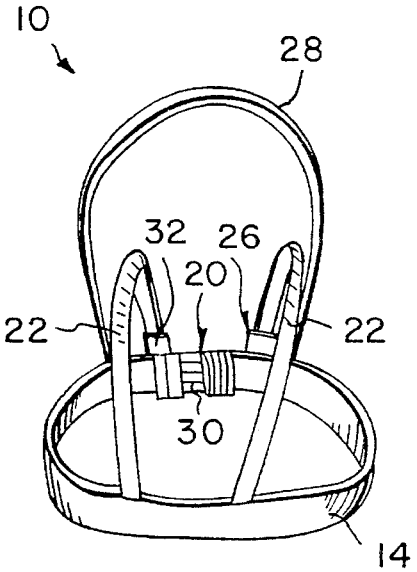
FIG. 2 is a front perspective view of the instant invention per se.

Turning now descriptively to the drawings, in which similar reference characters denote similar elements throughout the several views, FIGS. 1 and 2 illustrate a first walker aid 10 for an infant 12, which consists of a chest strap 14 applied about the upper torso 16 of the infant 12 to pass under the arms 18. Components 20 are for adjustably fastening the ends of the chest strap 14 together at the back of the infant 12 a pair of shoulder straps 22 are each spaced apart and connected to the chest strap 14, so as to extend over the shoulders 24 of the infant 12. Elements 26 are for adjusting each shoulder strap 22, so that the shoulder straps 22 will properly fit onto the shoulders 24 of the infant 12. A hold handle strap 28 is affixed to the chest strap 14 at the back of the infant 12, so that an adult can grip the hold handle strap 28 to retain the infant 12 when walking and prevent the infant 12 from falling down.

Each adjustably fastening component 20 is a snap buckle 30 on the ends of the chest strap 14. The adjusting elements 26 are a pair of slide buckles 32, each located on one shoulder strap 22.

Figure 3:
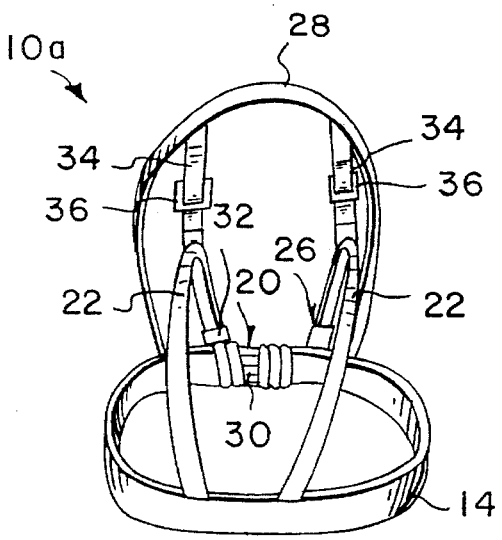
FIG. 3 is a front perspective view similar to FIG. 2 of a modification in which adjustable safety straps with buckles extend between the shoulder straps and the hold handle strap.

A modified first walker aid 10*a*, shown in FIG. 3, contains a pair of adjustable safety straps 34, each having a buckle 36 and extending between one shoulder strap 22 and the hold handle strap 28. When the safety straps 34 are adjusted, they will stabilize the infant 12 when walking, to prevent the infant 12 from tipping forward when the adult pulls back on the hold handle strap 28.

OPERATION OF THE INVENTION

To use the first walker aid 10, an adult places the chest strap 14 about the upper torso 16 and under the arms 18 of the infant 12. The snap buckle 30 is then connected together at the back of the infant 12. The shoulder straps 22 are then adjusted with the slide buckles 32, so that they will fit over the shoulders 24 of the infant 12. The adult can then grip the hold handle strap 28 to retain the infant 12 when walking.

To use the first walker aid 10*a*, the adult will follow the steps as stated above with the exception of adjusting the safety straps 34 with each buckle 36. This will prevent the infant 12 from tipping forward when the adult pulls back on the hold handle strap 28.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A first walker aid for an infant which comprises:

a) a chest strap applied about the upper torso of the infant to pass under the arms;

b) means for adjustably fastening the ends of said chest strap together at the back of the infant;

c) a pair of shoulder straps, spaced apart and connected to said chest strap, so as to extend over the shoulders of the infant;

d) means for adjusting each shoulder strap, so that said shoulder straps will properly fit onto the shoulders of the infant;

e) a hold handle strap affixed to said chest strap at the back of the infant, so that an adult can grip said hold handle strap to retain the infant when walking and prevent the infant from falling down; wherein said adjustably fastening means is a snap buckle on the ends of said chest strap; wherein said adjusting means includes a pair of slide buckles each located on one said shoulder strap; further including a pair of adjustable safety straps, each having a buckle and extending between one said shoulder strap and said hold handle strap, so that when said safety straps are adjusted they will stabilize the infant when walking to prevent the infant from tipping forward when the adult pulls back on said hold handle strap.

* * * * *